US009238543B2

(12) United States Patent
Kern et al.

(10) Patent No.: US 9,238,543 B2
(45) Date of Patent: Jan. 19, 2016

(54) CONTAINER FOR THE AT LEAST SUBSTANTIALLY SEPARATE STORAGE AND RELEASE OF SUBSTANCES, IN PARTICULAR FOR STORAGE AND RELEASE IN OUTER SPACE

(71) Applicant: Astrium GmbH, Taufkirchen (DE)

(72) Inventors: Peter Kern, Salem (DE); Jessica Janson, Wahlwinkel (DE); Crispin Szydzik, Napoleons (AU)

(73) Assignee: Airbus DS GmbH, Taufkirchen (DE)

( * ) Notice: Subject to any disclaimer, the term of this patent is extended or adjusted under 35 U.S.C. 154(b) by 0 days.

(21) Appl. No.: 13/969,679

(22) Filed: Aug. 19, 2013

(65) Prior Publication Data

US 2014/0054314 A1 Feb. 27, 2014

(30) Foreign Application Priority Data

Aug. 21, 2012 (DE) ..... 10 2012 107 652

(51) Int. Cl.
*B67D 7/70* (2010.01)
*B65D 83/00* (2006.01)
(Continued)

(52) U.S. Cl.
CPC ..... *B65D 83/0005* (2013.01); *A61J 1/062* (2013.01); *B65D 25/04* (2013.01); *B65D 81/325* (2013.01); *B65D 83/0033* (2013.01); *B65B 29/10* (2013.01)

(58) Field of Classification Search
CPC ..... A61M 2005/1787; A61M 3/005; A61M 5/284; B65D 81/325; B65D 81/3255; B65D 83/0044; B65D 25/04; B65D 83/0005; B65D 83/0033; A61J 1/062; B65B 29/10
USPC ..... 222/1, 129, 132, 145.1, 145.5, 386, 130
See application file for complete search history.

(56) References Cited

U.S. PATENT DOCUMENTS 3,911,916 A 10/1975 Stevens
4,439,184 A 3/1984 Wheeler
(Continued)

FOREIGN PATENT DOCUMENTS

DE 94 03 512.1 U1 5/1994
DE 696 22 909 T2 12/2002
(Continued)

OTHER PUBLICATIONS

Search Report issued in corresponding DE patent application No. 10 2012 107 652.9 (and partial English translation).
(Continued)

*Primary Examiner* — Frederick C Nicolas
*Assistant Examiner* — Bob Zadeh
(74) *Attorney, Agent, or Firm* — Posz Law Group, PLC

(57) ABSTRACT

The invention relates to a container, particularly in syringe form, for an at least substantially separate storage and release of substances, in particular for storage and release in outer space, with an outflow opening, a storage chamber for the storage of the substances, with at least one slideable separator element which divides the storage chamber into sub-chambers, and with at least one shaped overflow channel which is provided for transporting substances from a sub-chamber into a sub-chamber which is arranged forward as seen in the direction of the outflow opening, and/or into the outflow opening. It is proposed that the overflow channel and the separator element are designed for an at least substantially sequential release of substances and/or for washing-out a stored solid by a liquid.

11 Claims, 3 Drawing Sheets

Figure 1:
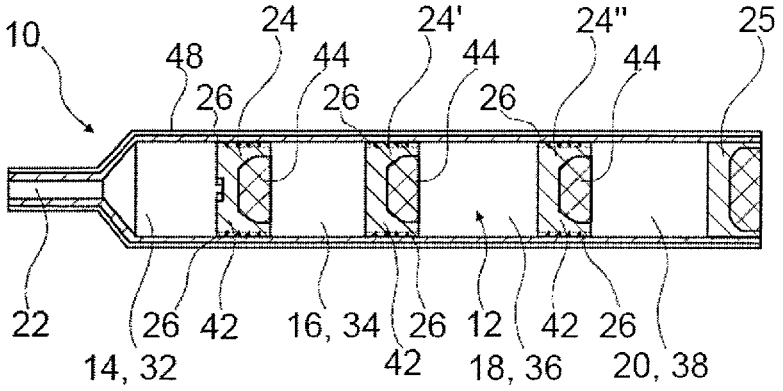

(51) Int. Cl.

| | |
|---|---|
| ***A61J 1/06*** | (2006.01) |
| ***B65D 25/04*** | (2006.01) |
| ***B65D 81/32*** | (2006.01) |
| *B65B 29/10* | (2006.01) |

(56) References Cited

U.S. PATENT DOCUMENTS

| | | | | |
|---|---|---|---|---|
| 4,599,082 | A | 7/1986 | Grimard | |
| 4,715,854 | A | 12/1987 | Vaillancourt | |
| 5,335,773 | A * | 8/1994 | Haber et al. | 206/221 |
| 5,702,182 | A * | 12/1997 | Alvarado | 366/130 |
| 5,713,857 | A | 2/1998 | Grimard et al. | |
| 7,866,465 | B2 * | 1/2011 | Dverin | 206/219 |

FOREIGN PATENT DOCUMENTS

| | | | |
|---|---|---|---|
| DE | 600 21 275 | T2 | 12/2005 |
| EP | 1 032 471 | B1 | 4/2002 |
| JP | 05-031191 | A | 2/1993 |
| JP | 06-094584 | A | 4/1994 |
| JP | 10-057487 | A | 3/1998 |
| JP | 10-080485 | A | 3/1998 |
| JP | 2004-065461 | A | 3/2004 |
| JP | 2004-538043 | A | 12/2004 |
| JP | 2005-027805 | A | 2/2005 |
| WO | 2008/150208 | A1 | 12/2008 |

OTHER PUBLICATIONS

Office Action mailed Jul. 1, 2014 issued in corresponding JP patent application No. 2013-168474 (and English translation).

Office Action mailed Feb. 12, 2015 issued in corresponding CA patent application No. 2,823,930 (in English).

European Search Report and Written Opinion mailed Aug. 25, 2015 issued in corresponding EP patent application No. 13179434.9 (partial English translation attached).

* cited by examiner

CONTAINER FOR THE AT LEAST SUBSTANTIALLY SEPARATE STORAGE AND RELEASE OF SUBSTANCES, IN PARTICULAR FOR STORAGE AND RELEASE IN OUTER SPACE

CROSS REFERENCE TO RELATED APPLICATIONS

This application is based on and incorporates herein by reference German Patent Application No. 10 2012 107 652.9 filed on Aug. 21, 2012.

PRIOR ART

The invention relates to a container according to the preamble of claim 1.

For chemical analysis methods, in particular for biochemical analysis methods, for example immunoassays, a large number of different reagents and auxiliary substances are needed. To perform an immunoassay, for example, capture antibodies (cAB) and detection antibodies (dAB) and also markers, such as fluorescent dyes, chromogenic compounds or chemiluminescent compounds, enzymes, and auxiliaries such as washing solutions, additives and auxiliary substances, acid or basic solutions and, possibly, solvents for dissolving dry-stored substances, are needed as reagents. These substances are usually stored separately in storage containers and, in order to perform an analysis, have to be added in the correct sequence and with defined volumes. The necessarily separate removal of the individual substances from individual storage containers and the in each case separate addition of the substances for the analysis is a source of a wide variety of errors, for example mixing up the storage containers, removing and adding an incorrect volume of a substance, or escape of hazardous substances, for example toxic, aggressive or cytostatic substances, during the removal from a storage container.

A similar problem concerning the need to add required substances in an exactly required amount and concerning corresponding storage in individual portions arises in respect of the administration of medicines.

To substantially avoid these sources of error and to substantially reduce the possibility of escape of hazardous substances, multi-compartment syringes are already known in which all the substances required for a medical administration can be stored, mixed and/or injected, together in the correct volumes.

Advantages of the Invention

The invention relates to a container, particularly in syringe form, for the at least substantially separate storage of substances, in particular for storage and release in outer space, with an outflow opening, a storage chamber for the storage of the substances, and with at least one slideable separator element which divides the storage chamber into sub-chambers and which has at least one shaped overflow channel which is provided for transporting substances from a sub-chamber into a sub-chamber which is arranged forward as seen in the direction of the outflow opening, and/or into the outflow opening. In particular, the separator element is intended to be slid by a pressure applied to one end of the container, to a specially shaped end separator element as closure element of a last sub-chamber, and/or to a last separator element. In principle, however, the separator element can also have specially provided sliding means, for example a built-in magnet which applies a sliding force to the separator element by means of an external magnet, or a slide handle which extends in a specially provided groove of the container and can be moved in order to slide the separator element. "Storage and release in outer space" is to be understood in particular as meaning that the storage and release take place outside Earth, for example in a space vehicle such as a space probe, or in an Earth orbit or at a Lagrange point, during a space flight or a circuit round another planet or round a moon, on a satellite, on a moon, on an asteroid or on a planet other than Earth. In particular, the storage and release in outer space can take place under conditions of reduced gravity. "Conditions of reduced gravity" are to be understood in particular as conditions in which there is a gravity effect of at most 0.9 g, advantageously of at most $1*10^{-3}$ g, preferably of at most $1*10^{-6}$ g and particularly preferably of at most $1*10^{-8}$ g, wherein g designates the value of the gravitational acceleration on Earth of 9.81 $m/s^2$. An "overflow channel" is to be understood in particular as a recess and/or a conduit which, at least after a predetermined effective force in a direction of the outflow opening has been exceeded, is intended to permit substance transport through the recess and/or conduit in the direction of the outflow opening. In particular, elements can be arranged in the overflow channel which prevent substance transport through the overflow channel when the effective force is not reached in the direction of the outflow opening. An "effective force" is to be understood in particular as a resulting force acting in one direction on an element and arising from the sum of all the forces acting on the element. A "shaped overflow channel" is to be understood in particular as an overflow channel which is already present at the container before the container is filled and before a start of a release process. In particular, the overflow channel is formed directly during production of a main body of the container and/or during production of the separator element. Moreover, it is possible to vary the number of the separator elements arranged in the main chamber. The container can in particular also have a basic shape different than that of a syringe, for example designed as a tube with a screw cap or with a closure for crimp caps with an inserted septum.

It is proposed that the overflow channel and the separator element are designed for an at least substantially sequential release of substances and/or for washing-out a stored solid by a liquid. An "at least substantially sequential release of substances and/or washing-out of a stored solid by a liquid" is to be understood in particular as meaning that a release of substances from different sub-chambers takes place at least substantially free of mixing and the substances are released at least substantially separately in a sequence of their arrangement in sub-chambers, as seen from a direction from the outflow opening to an end of the container directed away from the outflow opening, wherein stored solids, before passing through the outflow opening, are dissolved by a liquid, which is suitable as solvent for the solid, from the rear chamber as seen in the direction from the outflow opening. "At least substantially free of mixing" is to be understood in particular as meaning that, during a release and/or storage, and apart from dissolving of a stored solid by a solvent, a stored substance inside the container forms, with another substance, a mixture with a maximum volume fraction of the further substance of at most five percent by volume, advantageously at most one percent by volume and preferably at most a half percent by volume. In particular, a release of substances at least substantially free of mixing differs from a release in which the substances from different sub-chambers are brought successively into a frontmost area of the container and are mixed there and are released from the container in a mixed state. Preferably, the overflow channel and the separator element are designed for an at least substantially sequential release of substances and/or for washing-out a stored solid by a liquid in such a way that the sequential release can also take place under conditions of reduced gravity. In particular, storage of substances for a reaction with a required volume and in a correct sequence can be achieved, and incorrect release of the substances with unsuitable volumes and/or in an incorrect sequence can be avoided.

It is further proposed that the separator element has the overflow channel. In particular, at least substantially any desired number and size of sub-chambers can be achieved by inserting a corresponding number of separator elements into a container, and, in particular, a main body of the container with the main chamber can be designed as a conventional syringe body.

It is further proposed that the overflow channel is arranged on an outside of the separator element. It is possible in particular to achieve structurally simple production of the overflow channel.

Moreover, at least a second overflow channel is proposed, wherein the overflow channels are arranged symmetrically to each other. In particular, the overflow channels are arranged symmetrically to each other on an outside of the separator element. On its outside, the separator element preferably has a plurality of overflow channels, in particular four, advantageously six and preferably eight overflow channels, arranged symmetrically to each other. It is possible in particular to obtain an advantageous distribution of a substance across a sub-chamber and/or the outflow opening and also a uniform release of substance.

It is further proposed that the separator element has at least one sealing element which is provided for sealing off a sub-chamber. In particular, the sealing element is arranged on an outside of the separator element. Preferably, the sealing element is formed by a circumferential sealing lamella. It is possible in particular to increase the probability of storage free of mixing, and to reduce the force that has to be applied for sliding the separator element.

At least one overpressure element, which is arranged in the overflow channel, is also proposed. An "overpressure element" is to be understood in particular as an element which, when a predetermined effective force, in particular an effective pressure force, on the element is reached or exceeded, permits transport of substance through the element and, when the predetermined effective force is not reached, prevents the transport of substance. In particular, the overpressure element has a sub-element which is movable by pressure and which by a movement, for example a folding movement and/or sliding movement, frees an opening for the transport of substance, and/or the overpressure element is provided to form the opening by damage when the predetermined effective force is reached. It is possible in particular to prevent mixing of stored substances through the overflow channels.

It is also proposed that the overpressure element has a predetermined tearing point. A "predetermined tearing point" is to be understood in particular as an area of the overpressure element which, when the predetermined effective force is reached, is intended to form an opening through damage of the overpressure element. It is possible in particular to obtain an overpressure element of simple design.

It is also proposed that the overpressure element is provided for a mechanical deformation. "Provided for a mechanical deformation" is to be understood in particular as meaning that the overpressure element is specially designed such that, when a predetermined effective force is reached, it frees a sub-region of the overflow channel by damage-free deformation, for example an elastic deformation, a folding back or turning back. It is possible in particular to obtain an overpressure element of simple design.

At least one transverse distributor channel is also proposed, which is provided for distributing substances along a transverse direction of the storage chamber. The transverse distributor channel is preferably arranged on the separator element. A "transverse distributor channel" is to be understood in particular as a shaped channel which is connected fluidically to at least one overflow channel and which, at least in an assembled state, extends along a transverse direction of the main chamber and is provided such that substances transported through the overflow channel are distributed along the transverse direction. The separator element preferably has a large number of transverse distributor channels which run together and which are each connected to a respective overflow channel. Alternatively, a large number of transverse distributor channels can be designed in such a way, for example, that each transverse distributor channel connects two overflow channels to each other and runs parallel to these. It is possible in particular to obtain an advantageous distribution of transported substances over an entire diameter in the transverse direction and a uniform volumetric flow.

It is also proposed that the separator element has at least one elastic sub-region designed as a pierceable membrane. A "pierceable membrane" is to be understood in particular as an elastic sub-region which, in an undamaged state, is designed to be impermeable and is provided for a separation of substances, and which is intended to be pierced by a hollow needle and is designed to be impermeable once again after withdrawal of the hollow needle. It is possible in particular to obtain a simple way of filling the sub-chambers.

At least one functional coating applied on at least one area of a surface of the storage chamber and/or of the separator element is also proposed. A "functional coating" is to be understood in particular as a coat applied on a surface in a thickness of at most 1 mm, advantageously of at most 0.1 mm and preferably of at most 0.01 mm, which also has an additional function, for example an anti-adhesion function, a friction-reducing function, or a function for reducing non-specific binding of stored substances to a material of the surface. In particular, the functional coating can be formed by a nano-coating. A "nano-coating" is to be understood in particular as a coating with a thickness of a few atomic layers. A nano-coating is preferably formed from a monomolecular layer. A functional coating can be formed, for example, by a coating with BSA (bovine serum albumin) for reducing non-specific binding, with polyethylene glycol, with poloxamers, for example the poloxamer obtainable under the trade name Pluronic®, or with polysorbates, for example the polysorbate obtainable under the trade name Tween®, or a Teflon or silicone coating for friction reduction. Alternatively, instead of a functional coating, a functionalization of a surface can be achieved by means of a surface treatment, for example a corona treatment or a low-pressure plasma treatment for generating special functional groups, preferably OH groups, on the surface. An improved storage function can be achieved in particular.

At least one end separator element is also proposed, which is provided for closing a rearmost sub-chamber. An "end separator element" is to be understood in particular as a separator element which is free of overflow channels and has at least one circumferential layer of sealing elements. A "circumferential layer of sealing elements" is to be understood in particular as meaning that the end separator element has at least one sealing element extending about an entire circumference and/or a large number of sealing elements extending contiguously about the entire circumference without gaps between them. The end separator element preferably has a plurality of circumferential layers of sealing elements, for example three layers of sealing elements. In particular, the end separator element is intended to close off the rearmost sub-chamber to the rear and in particular to prevent transport of substance from the sub-chamber in a direction away from an outflow opening. The end separator element can in particular be integrated into a movable piston of the container. Except for being free of overflow channels, the end separator element is preferably designed analogously to the separator elements. A "rearmost sub-chamber" is to be understood in particular as a last sub-chamber as seen in a direction away from the outflow opening. It is possible in particular to achieve a secure closure of a rearmost sub-chamber.

A method for the at least substantially sequential release of substances from a container according to the invention is also proposed, in which method the sequential release takes place under conditions of reduced gravity. It is possible in particular to prevent disturbance conditions, such as gravity-induced sedimentation of stored substances.

It is also proposed that, in at least one further method step between two method steps for the release of a substance portion, the separator element is free from an effect of a force. It is possible in particular to obtain a rest period, for the reaction of released substances, before further substances are added.

It is also proposed that a release is effected by an external, controllable technical release device. A "technical release device" is to be understood in particular as a technical device which has at least one input unit for entering commands and/or a control unit with a memory for executing a stored control program, and a release unit which, by means of a pressure or suction process, effects a release of substance portions from the container. The external, controllable technical release device is preferably provided for automated or partially automated release. Instead of using an external controllable technical release device, a release can in principle also be achieved by a manual operation or by means of an auxiliary tool or an auxiliary device. It is possible in particular to achieve high-precision release of substance portions and high process efficiency.

The container according to the invention is not intended to be limited to the use and embodiment described above. In particular, to perform a function described herein, the container according to the invention can have a number different than the herein specified number of individual elements, components and units.

DRAWINGS

Further advantages will become clear from the following description of the drawings. The drawings show an illustrative embodiment of the invention. The drawings, the description and the claims contain many features in combination. A person skilled in the art will, as appropriate, also consider the features individually and group them together to form further meaningful combinations.

Figure 2:
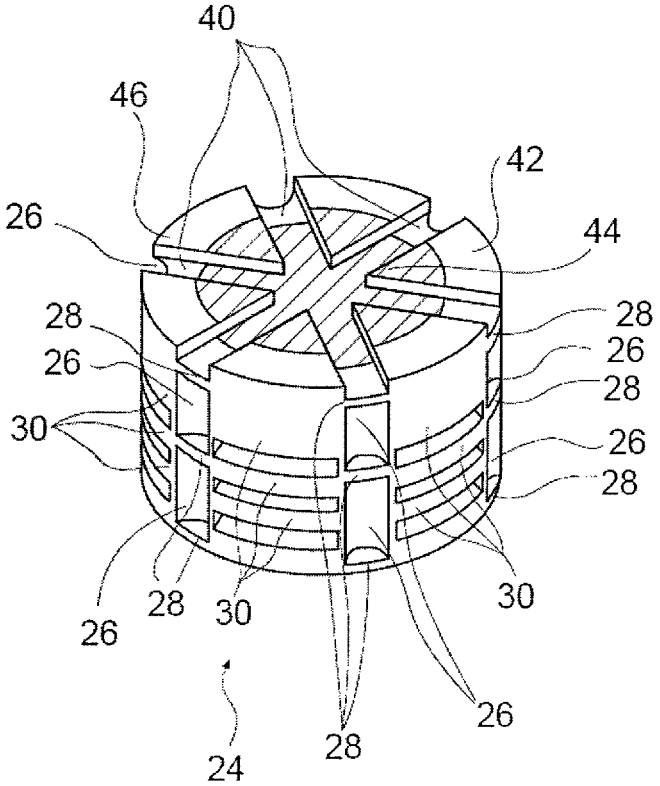
Figure 3:
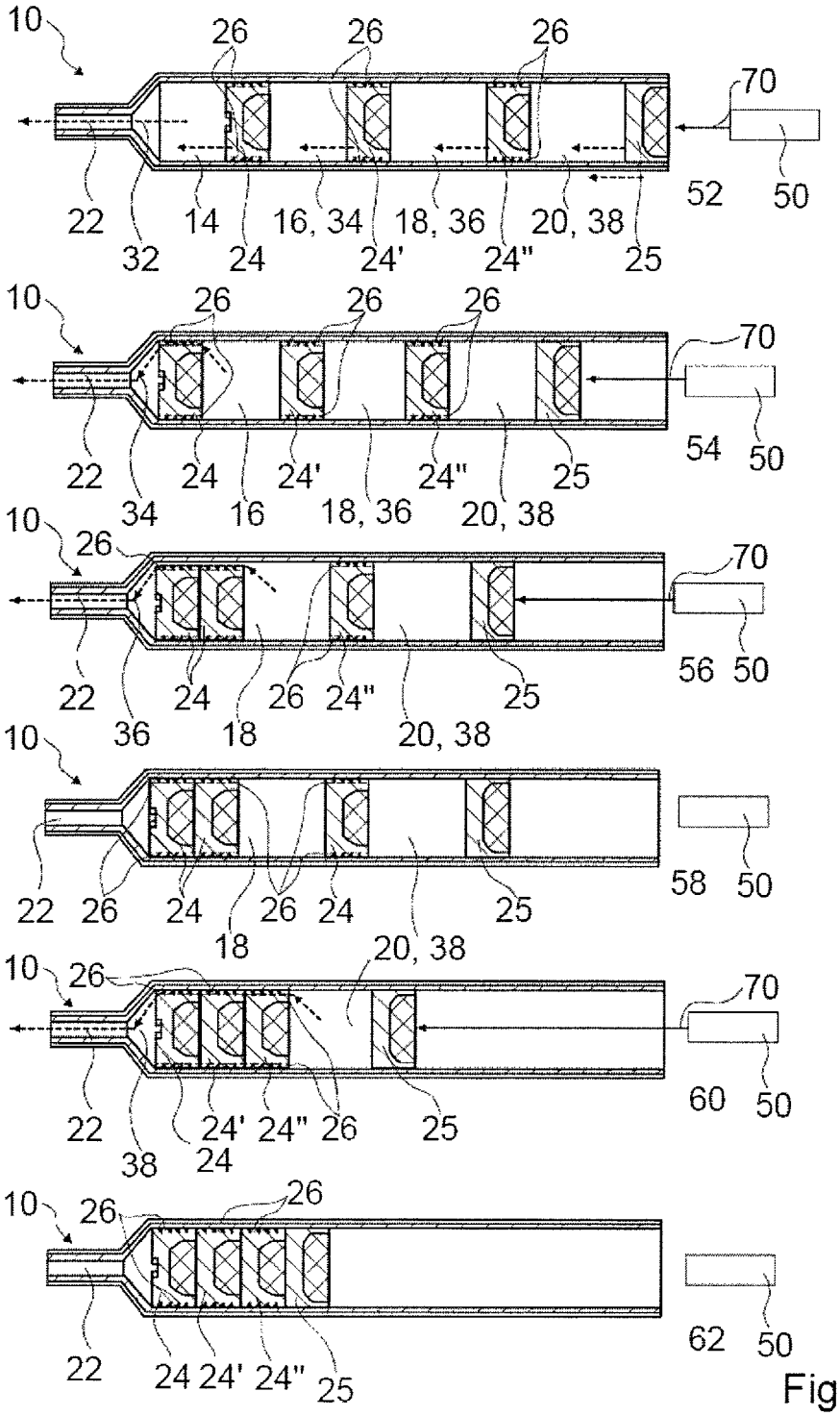
Figure 4:
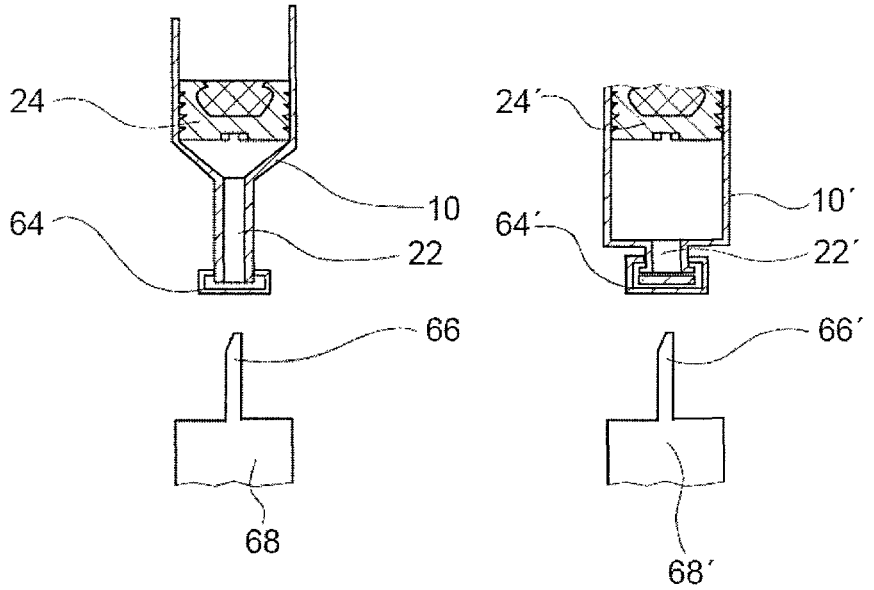
Figure 5:
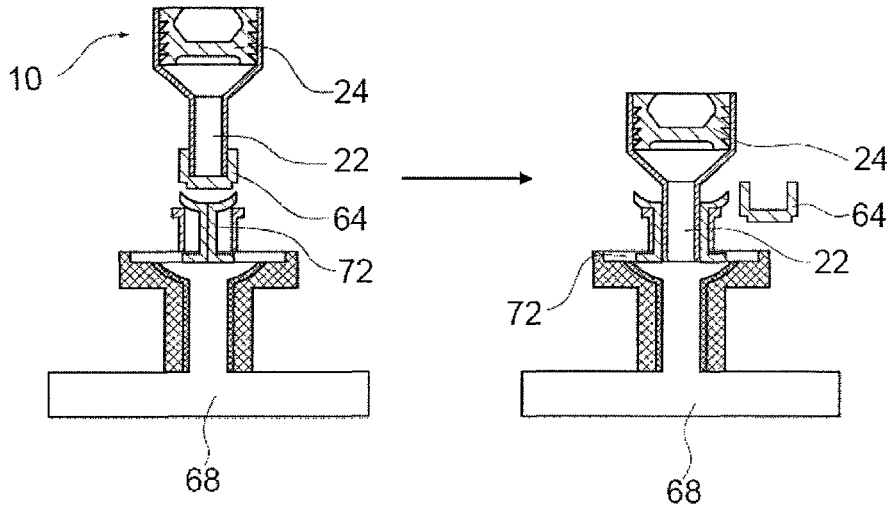

In the drawings:

FIG. 1 shows a storage container according to the invention with four separator elements, FIG. 2 shows a detailed view of a separator element according to the invention, FIG. 3 shows a sequential release of substances from a container according to the invention, FIG. 4 shows a view of a closed container according to the invention, and of a process vessel which is provided for connection to the container, and FIG. 5 shows a procedure for connecting a container according to the invention to a process vessel, which has a slit septum.

DESCRIPTION OF THE ILLUSTRATIVE EMBODIMENTS

FIG. 1 shows a container 10 according to the invention, in syringe form, for the at least substantially separate storage of substances, with an outflow opening 22, a storage chamber 12 for the storage of the substances, and three slideable separator elements 24, 24', 24", which divide the storage chamber 12 into sub-chambers 14, 16, 18, 20, and with an end separator element 25, which is provided for closing a rearmost sub-chamber. The container 10 can in particular also have a basic form different than that of a syringe, for example as a tube with a screw cap or with a closure for crimp caps, both with an inserted septum. The separator elements 24, 24', 24" have, arranged on the outsides, shaped overflow channels 26 which are provided for transporting substances from one of the sub-chambers 14, 16, 18, 20 into a sub-chamber 14, 16, 18 which is arranged forward as seen in the direction of the outflow opening 22, and/or into the outflow opening 22. The outflow opening 22 is formed by a cone-shaped nozzle at a tapering end of a main body of the container 10. In an alternative design, the outflow opening 22 can also be cylindrical, for example. The end separator element 25 is of the same diameter as the separator elements 24, 24', 24" and differs from these principally in that it is free of overflow channels 26 and has three circumferential layers of sealing elements. The end separator element 25 is provided for secure closure of the rearmost sub-chamber 20. In alternative designs, the end separator element 25 can be integrated in a movable piston of the container 10. In the text below, a statement of direction "forward" refers to a direction leading to the outflow opening 22, and a statement of direction "rearward" refers to a direction leading away from the outflow opening 22. The overflow channels 26 and the separator elements 24, 24', 24" are designed for an at least substantially sequential release of substances and/or for washing-out a stored solid by a liquid. A substance portion 32, 34, 36, 38 is in each case stored in the respective sub-chambers 14, 16, 18, 20. The substance portions 32, 34, 36, 38 are each formed from different liquid substances, although in principle several of the substance portions 32, 34, 36, 38 could be formed from identical substances, and/or at least one of the substance portions 32, 34, 36 can be formed from a solid that is to be dissolved. The solid is preferably formed from dried antibodies, chromogenic or fluorophore dyes or enzymes. A size of the sub-chambers 14, 16, 18, 20 is defined by a distance of the separator elements 24, 24', 24" from one another and by the distance of the frontmost separator element 24 from the outflow opening 22 and the distance of the rearmost separator element 24" from the end separator element 25. In an alternative design, instead of the end separator element 25, it is possible to use an element which is identical to the separator elements 24, 24', 24" and which likewise has overflow channels 26. The end separator element 25 can be designed as a component part of a piston, by means of which a pressure can be applied to the rearmost substance portion 38 and to the separator elements 24, 24', 24" and substance portions 32, 34, 36 lying in front of this, and a sequential release of the substance portions 32, 34, 36, 38 can be effected.

The main body, which forms the storage container 12 and the outflow opening 22, is surrounded by an additional cover layer 48, which is formed from a Teflon heat-shrink hose. The additional cover layer 48 is provided to protect a user of the container 10 when dealing with hazardous substances stored in the container 10, for example toxic or carcinogenic substances. For this purpose, the additional cover layer 48 lies like an onion skin around the main body. Instead of a Teflon heat-shrink hose, it is also possible to use adhesive tapes and/or adhesive labels or coatings with an elastic material. Instead of a single additional cover layer 48, it is possible to enclose the container 10 in a plurality of additional cover layers 48, for example three cover layers 48. The main body is preferably produced from a biocompatible plastic with low non-specific binding ability, for example a COC (cyclo-olefin copolymer) or PEEK (polyether ether ketone). In principle, however, the main body can also be produced from other plastics, for example polystyrene, polyethylene, polycarbonate or polypropylene, or from another material, for example from a metal or from glass. The main body is preferably transparent.

The separator element 24 (FIG. 2) has in each case a hard core 44 which is arranged centrally in an upper area directed toward the outflow opening 22 in an assembled state of the separator element 24 and extends over half a longitudinal extent of the separator element 24. The separator elements 24' and 24" are designed identically to this. Moreover, the separator element 24 has an elastic sub-region 42 which is designed as a pierceable membrane and which surrounds the hard core 44. The elastic sub-region 42 is impermeable in an undamaged state and is provided for the separation of substances. The elastic sub-region 42 can be pierced by a hollow needle in order to fill a rearward sub-chamber 16, 18, 20 with a substance portion 32, 34, 36, and it is also designed to be impermeable after withdrawal of the hollow needle. The hard core 44 is produced from a material with a greater stiffness than the elastic sub-region 42. In particular, the hard core 44 is produced from a hard plastic such as polypropylene or polyethylene. In principle, other elastic materials, biocompatible plastics, such as COP or PEEK, or other materials such as a metal, can also be used to produce the hard core. In principle, the hard core 44 can be omitted, and the separator element 24 can consist only of the elastic sub-region 42. The elastic sub-region 42 of the separator element 24 is preferably produced from an elastic material that is softer than a plastic material of the hard core 44, or alternatively of silicone or rubber. Over an entire surface, the separator element has a transparent functional coating 46 of BSA (bovine serum albumin) for reduction of non-specific binding of the stored substances to the separator element 24. Alternatively, it is also possible for just some areas of the surface of the separator element 24 to have the functional coating 46, for example a top face and bottom face of the separator element 24. Alternatively or in addition, it is also possible for a surface of the main body of the container 10, which forms the storage container 12, to have the functional coating 46. It is also possible to use a functional coating 46 made from other substances, for example from a poloxamer such as Pluronic® or a polysorbate such as Tween®.

The separator element 24 has six overflow channels 26. The overflow channels 26 are arranged symmetrically to one another on an outside of the separator element 24. In principle, the separator elements 24 can also have another number of overflow channels 26, wherein the separator elements 24 preferably have one overflow channel 26 and at least a second overflow channel 26, wherein the overflow channels 26 are arranged symmetrically to one another. In the overflow channels 26, three overpressure elements 28 are arranged, of which one overpressure element 28 is arranged at one end of the overflow channel 26 and one is arranged at a center of the overflow channel 26. The overpressure elements 28 are designed as sealing lamellae and each have a predetermined tearing point which is intended to start tearing when a predetermined effective pressure in the direction of a top face of the separator element directed toward the outflow opening 22 in the assembled state is exceeded. In an alternative design, the overpressure elements can be provided for a mechanical deformation and, when the predetermined effective pressure is exceeded, they deform elastically for example or fold back. In a storage state, and during the release of a substance portion 32, 34, 36 stored in a forward sub-chamber 14, 16, 18 in front of the respective separator element 24, the overpressure elements 28 are intended to ensure that the substance stored in the rearward sub-chamber 16, 18, 20 is not mixed with the substance stored in the forward sub-chamber 14, 16, 18 and to allow the substance stored in the rearward sub-chamber 16, 18, 20 to be released into the forward sub-chamber 14, 16, 18 after the forward sub-chamber 14, 16, 18 has been emptied.

In areas between the overflow channels 26, the separator element 24 also has three sealing elements 30 which are arranged one above another and which are provided for sealing off a sub-chamber 14, 16, 18, 20. In principle, in alternative designs, the separator element 24 can have a different number of sealing elements 30 arranged one above another in areas between the overflow channels 26. The sealing elements 30 are designed as sealing lamellae. Moreover, the sealing elements 30 mean that less force is applied to slide the separator element 24, since only a frictional resistance of the sealing elements 30 with the material of the main body has to be overcome during sliding, instead of a frictional resistance of an entire outer face of the separator element 24 with the material of the main body.

A transverse distributor channel 40, which is provided for distributing substances along a transverse direction of the storage chamber 12, is arranged on the top face of the separator element 24. The transverse distributor channel 40 connects ends of the overflow channels 26 to one another in a star shape and causes a uniform distribution of transported substances across an entire transverse extent of the storage chamber 12.

FIG. 3 shows an example of the sequence of a method for the at least substantially sequential release of substances from the container 10. The container 10 can in principle have one or more additional cover layers 48. In the method shown, the sequential release takes place under conditions of reduced gravity, for example on board a space vehicle in outer space or in low Earth orbit. A release is effected by an external, controllable technical release device 50. The external, controllable technical release device 50 is indicated only schematically and can be designed, for example, as an electromechanical piston device controlled by a computer. Alternatively, the external, controllable technical release device 50 can also be controlled manually, or a release can be effected by hand by a user in a manual operation or by means of an auxiliary tool or an auxiliary device. Preferably, the release by the external, controllable technical release device 50 is automated or partially automated. The external, controllable technical release device 50 can comprise a robotic arm for moving the container 10 during transport and/or during release of substance portions 32, 34, 36, 38. In a first method step 52, a force 70 is applied to the end separator element 25 by means of the external, controllable technical release device 50, which force is transmitted as pressure to the substance portion 38 in the sub-chamber 20 lying in front and to the separator elements 24, 24', 24" and substance portions 32, 34, 36. The frontmost substance portion 32 is released through the outflow opening 22 as a result of the pressure, and the frontmost sub-chamber 14 empties. Through an emptying of the frontmost sub-chamber 14, it is possible for the separator elements 24, 24', 24", the end separator elements 25, the other substance portions 34, 36, 38 and the sub-chambers 16, 18, 20 to be slid accordingly in the direction of the outflow opening 22. Sliding the separator elements 24, 24', 24" and the end separator element 25 takes place simultaneously with the emptying of the frontmost sub-chamber 14. The predetermined tearing points of the overpressure elements 28 are designed in such a way, and adapted to a pressure acting on them in such a way, that the overpressure elements 28 remain intact during a sliding procedure and, in this way, a transfer of substance from one of the rearward sub-chambers 16, 18, 20 into the sub-chambers 14, 16, 18 does not occur.

In a following method step 54, the frontmost substance portion 32 is completely released and the frontmost separator element 24 has thus been slid to an area of the main body of the container 10 narrowing toward the outflow opening 22, which area serves as blockade element and prevents further sliding of the separator element 24. The external, controllable technical release device 50 still applies a force 70, which acts as pressure on the frontmost separator element 24 and is now free from a partial compensation by a hydrostatic pressure of the frontmost substance portion 32, such that the predetermined tearing points of the overpressure elements 28 of the separator element 24 tear and permit transport of substance through the overflow channels 26 of the separator element 24. The substance portion 34 stored in the sub-chamber 16 lying behind can thus flow through the overflow channels 26 into the outflow opening 22 and be released. The sub-chamber 16 is thus emptied, and the separator elements 24', 24" lying behind it, the end separator element 25 and the sub-chambers 18, 20 with the stored substance portions 36, 38 are slid forward in the direction of the outflow opening 22.

In a further method step 56, the sub-chamber 16 is completely emptied, and the separator element 24' adjoining the sub-chamber 16 from behind has been slid as far as the frontmost separator element 24, which serves as a blockade element and prevents a sliding of the separator element 24'. Through the pressure still applied by the force 70, the predetermined tearing points of the overpressure elements 28 in the separator element 24' tear, and the substance portion 36 in the sub-chamber 18 is released via the overflow channels 26 of the forward separator elements 24. A sliding of the rear separator element 24" and of the end separator element 25 takes place analogously to the sliding in the preceding method steps 52, 54.

In a further method step 58, between two method steps 56, 60 for the release of substance portions 32, 34, 36, 38, the end separator element 25 is free from the effect of the force 70. Freedom from force is brought about by a control of the external, controllable technical release device 50. The further method step 58 creates a pause in the release, which pause is needed to allow a complete reaction of the substance portions 32, 34, 36 before addition of the substance portion 38.

In a further method step 60, analogously to the preceding method steps 52, 54 and 56, the sub-chamber 20 is emptied and the substance portion 38 released.

In a final method step 62, the substance portion 38 is completely released, and application of a force 70 is discontinued by the external, controllable release device 50.

As an alternative to a release of substance portions 32, 34, 36, 38 by means of pressure, a sequential release can also be achieved by a suction process, by which the frontmost sub-chamber 14 is emptied and the separator elements 24, 24', 24" and the end separator element 25 are slid, analogously to the method steps 52, 54, 56, 58, 60 and 62, by an underpressure in the frontmost sub-chamber 14.

For storage, the outflow opening 22 of the container 10 can be closed off with a closure cap 64, adjoining which a septum insert can be arranged inside the outflow opening 22, or alternatively with an elastic sealing insert (FIG. 4). At the start of a release process, in order to open the container 10 the closure cap 64 can be removed or can be pierced by means of a canula 66 of a process vessel 68. Alternatively, after removal of the closure cap 64, the septum insert can be pierced by the canula 66 or the elastic sealing insert can be pierced. Alternatively, it is also conceivable that the container 10 and the process vessel 68 can be connected to each other as a Luer lock and, before the start of a release process, only the closure cap 64 of the container 10 has to be removed. In an alternative design, a container 10' has a cylindrical instead of a conical outflow opening 22' and is closed by a closure cap 64' with an inserted septum.

In another alternative design (FIG. 5), the process vessel 68 can be provided with a slit septum 72. The slit septum 72 can be divided along a pre-formed slit.

For a release process, the closure cap 64 of the container 10 is removed, and the container 10 is inserted at the outflow opening into the slit septum 72. The container 10 divides the slit septum 72 along the slit and is laterally surrounded by the slit septum 72 at the outflow opening. Slit septum 72 and container 10 establish a form-fit Luer lock connection. The Luer lock connection is covered in a sterile manner by the slit septum 72.

REFERENCE NUMERALS

10 container
10' container
12 storage chamber
14 sub-chamber
16 sub-chamber
18 sub-chamber
20 sub-chamber
22 outflow opening
22' outflow opening
24 separator element
24' separator element
24" separator element
25 end separator element
26 overflow channel
28 overpressure element
30 sealing element
32 substance portion
34 substance portion
36 substance portion
38 substance portion
40 transverse distributor channel
42 elastic sub-region
44 hard core
46 functional coating
48 additional cover layer
50 release device
52 method step
54 method step
56 method step
58 method step
60 method step
62 method step
64 closure cap

64' closure cap
66 canula
66' canula
68 process vessel
68' process vessel
70 force
72 slit septum

The invention claimed is:

1. A container for an at least substantially separate storage and release of substances comprising:

an outflow opening connected to a storage chamber for the storage of the substances, including at least one slideable separator element that divides the storage chamber into a first sub-chamber and a second sub-chamber, and includes an exterior surface and a top face directed toward the outflow opening, the at least one slideable separator element including at least one shaped overflow channel formed on the exterior surface of the at least one slideable separator element, which transports substances from the first sub-chamber into the second sub-chamber, and is arranged forward as seen in the direction of the outflow opening, and/or into the outflow opening, and at least one overpressure element formed in the at least one shaped overflow channel and configured to mechanically deform under a predetermined effective force, wherein the at least one shaped overflow channel and the at least one slideable separator element are configured to, at least substantially, sequentially release substances and/or wash-out a stored solid by a liquid, when the predetermined effective force is reached, the at least one overpressure element deforms elastically or folds back in the direction of the top face, and the at least one slideable separator element further comprises a hard core formed in a central region and to the front face of the at least one slideable separator element, a pierceable elastic sub-region formed on the front face and surrounding the hard core, and a transverse distributor channel formed on the front face and running parallel with the at least one shaped overflow channel.

2. The container according to claim 1, further comprising at least one second overflow channel, wherein the at least one shaped overflow channel and the at least one second overflow channel are arranged symmetrically to each other.

3. The container according to claim 1, wherein the at least one slideable separator element has at least one sealing element configured to seal off the first sub-chamber and/or the second sub-chamber.

4. The container according to claim 1, wherein the at least one overpressure element has a predetermined tearing point.

5. The container according to claim 1, wherein the at least one slideable separator element has at least one elastic subregion designed as a pierceable membrane.

6. The container according to claim 1, comprising at least one functional coating applied on at least one area of a surface of the storage chamber and/or of the at least one slideable separator element.

7. The container according to claim 1, comprising at least one end separator element, which is provided for closing a rearmost sub-chamber.

8. The container according to claim 1, further comprising a plurality of slideable separator elements, including at least a first separator element and a second separator element, the first separator element is configured to mate with a second separator element, and the second separator element is configured to mate with the first separator element.

9. The container according to claim 1, wherein the transverse distributor channel forms six wedges on the front face of the at least one slideable separator element.

10. The container according to claim 1, wherein there are six overflow channels.

11. A slideable separator element in a container for an at least substantially separate storage and release of substances, the container including an outflow opening connected to a storage chamber for the storage of the substances, the slideable separator element comprising:

at least one shaped overflow channel formed on an exterior surface of the slideable separator element, which transports substances from a first sub-chamber into a second sub-chamber, and is arranged forward as seen in the direction of the outflow opening, and/or into the outflow opening; and at least one overpressure element formed in the at least one shaped overflow channel and configured to mechanically deform under a predetermined effective force, wherein the at least one shaped overflow channel is configured to, at least substantially, sequentially release substances and/or wash-out a stored solid by a liquid, when the predetermined effective force is reached, the at least one overpressure element deforms elastically or folds back in the direction of a top face of the slideable separator element directed toward the outflow opening, and the slideable separator element further comprises a hard core formed in a central region and to the front face of the at least one slideable separator element, a pierceable elastic sub-region formed on the front face and surrounding the hard core, and a transverse distributor channel formed on the front face and running parallel with the at least one shaped overflow channel.

* * * * *